US009132460B2

(12) United States Patent
Moser et al.

(10) Patent No.: US 9,132,460 B2
(45) Date of Patent: Sep. 15, 2015

(54) DRIVER FOR A STEEL STRIP COILER

(75) Inventors: Friedrich Moser, Hellmonsödt (AT); Jürgen Schiefer, Stadt Haag (AT)

(73) Assignee: SIEMENS VAI METALS TECHNOLOGIES GMBH (AT)

( * ) Notice: Subject to any disclaimer, the term of this patent is extended or adjusted under 35 U.S.C. 154(b) by 331 days.

(21) Appl. No.: 13/877,121

(22) PCT Filed: Sep. 27, 2011

(86) PCT No.: PCT/EP2011/066707

§ 371 (c)(1),
(2), (4) Date: Mar. 29, 2013

(87) PCT Pub. No.: WO2012/045607

PCT Pub. Date: Apr. 12, 2012

(65) Prior Publication Data

US 2013/0200128 A1 Aug. 8, 2013

(30) Foreign Application Priority Data

Oct. 8, 2010 (AT) ..... A 1683/2010

(51) Int. Cl.
*B65H 20/02* (2006.01)
*B21C 47/34* (2006.01)

(52) U.S. Cl.
CPC ..... *B21C 47/3466* (2013.01); *B21C 47/34* (2013.01); *B21C 47/3425* (2013.01); *B65H 20/02* (2013.01); *B65H 2402/31* (2013.01);
(Continued)

(58) Field of Classification Search
CPC .... B65H 20/02; B65H 20/04; B65H 2402/31; B65H 2402/60; B65H 2402/64; B21C 47/34; B21C 47/3425; B21C 47/3466; Y10T 29/49815
See application file for complete search history.

(56) References Cited

U.S. PATENT DOCUMENTS

| | | | | |
|---|---|---|---|---|
| 4,119,256 A | | 10/1978 | Vogtmann et al. | 226/177 |
| 4,759,485 A | | 7/1988 | Braun et al. | 226/176 |
| 5,398,604 A | * | 3/1995 | Burke et al. | 101/216 |

(Continued)

FOREIGN PATENT DOCUMENTS

| | | |
|---|---|---|
| AT | 500689 B1 | 7/2008 |
| CA | 2572489 A1 | 1/2006 |

(Continued)

OTHER PUBLICATIONS

International Search Report and Written Opinion, Application No. PCT/EP2011/066707, 14 pages, Feb. 6, 2012.

*Primary Examiner* — William E Dondero
(74) *Attorney, Agent, or Firm* — Ostrolenk Faber LLP

(57) ABSTRACT

A driver for a steel strip coiler, having at least one supporting driving roller mounted on a frame, and at least one driving roller, which can be adjusted with respect to the supporting driving roller and is mounted on at least one rocker connected to the frame, wherein the driving roller is attached to a bearing region of the rocker. The bearing region is open for the insertion or removal of the driving roller toward the side and/or upwardly when the rocker is placed in the operating position. The driver has a fixing mechanism for fixing the driving roller to the bearing region. The method for removing a driving roller from such a driver includes opening the fixing mechanism and removing the driving roller toward the side or upwardly from the driver.

14 Claims, 4 Drawing Sheets

(52) U.S. Cl.
CPC ..... *B65H 2402/64* (2013.01); *Y10T 29/49815* (2015.01)

(56) References Cited

U.S. PATENT DOCUMENTS

| | | | | |
|---|---|---|---|---|
| 5,961,022 | A | 10/1999 | Pfeiffer et al. | 226/176 |
| 6,378,749 | B1 | 4/2002 | Robin | 226/90 |
| 2011/0240707 | A1 * | 10/2011 | Beguin et al. | 226/188 |
| 2013/0200128 | A1 | 8/2013 | Moser et al. | 226/181 |

FOREIGN PATENT DOCUMENTS

| | | | |
|---|---|---|---|
| CA | 2572489 | C | 10/2013 |
| CN | 2069761 | U | 1/1991 |
| CN | 2734357 | Y | 10/2005 |
| CN | 1980846 | A | 6/2007 |
| DE | 2656774 | A1 | 6/1977 |
| DE | 4340915 | A1 * | 8/1994 |
| DE | 4442567 | A1 | 6/1996 |
| EP | 0192982 | A2 | 9/1986 |
| EP | 1086916 | A2 | 3/2001 |
| EP | 1226886 | A1 | 7/2002 |
| EP | 0747147 | B2 | 3/2006 |
| GB | 1564437 | A | 4/1980 |
| JP | 11-197740 | | 7/1999 |
| JP | 2004066270 | A | 3/2004 |
| UA | 40444 | A | 7/2001 |
| WO | 2006/002835 | A1 | 1/2006 |
| WO | WO 2010066325 | A1 * | 6/2010 |
| WO | 2012/045607 | A1 | 4/2012 |

* cited by examiner

DRIVER FOR A STEEL STRIP COILER

CROSS-REFERENCE TO RELATED APPLICATIONS

This application is a U.S. National Stage Application of International Application No. PCT/EP2011/066707 filed Sep. 27, 2011, which designates the United States of America, and claims priority to AT Patent Application No. A1683/2010 filed Oct. 8, 2010. The contents of which are hereby incorporated by reference in their entirety.

TECHNICAL FIELD

The present disclosure relates to a driver for a steel strip coiler, having at least one supporting driving roller mounted on a frame, and at least one driving roller, which can be adjusted with respect to the supporting driving roller and is mounted on at least one rocker connected to the frame, wherein the driving roller is attached to a bearing region of the rocker, and also to a method for removing a driving roller from such a driver.

BACKGROUND

In driving devices, also called drivers, metal strip is clamped between a pair of rollers and driven or deflected. Drivers are typically used in rolling trains, where they are arranged upstream of rolled-strip coilers in order to set the strip tension upstream of the coiler by means of two rolls, namely the driving roller and the supporting driving roller. Directional drivers have the additional object of reducing lateral creeping of the rolled strip prior to coiling. To this end, for example the pivotable driving roller is actuated in such a way and is adjusted toward the stationary supporting driving roller that, on account of the position of the driving roller with respect to the supporting driving roller, the rolled strip undergoes a desired strip tension and a desired lateral displacement.

Such directional drivers are known for example from EP747147B1 or AT500689B1.

EP747147B1 shows a directional driver, the pivotable driving roller of which is arranged mounted between two rockers by means of the two ends of the driving roller axle. The two rockers are connected rigidly to a torsion spring of a frame which forms a rotary axle for the rockers.

AT500689B1 discloses a similar directional driver, in which, however, the rockers can be pivoted independently of one another on a rotary axle of a frame.

The driving roller and the supporting driving roller of a directional driver have to be cleaned and polished regularly, since, for example on account of carbon caking, particles of dirt present on the strip to be coiled, or surface defects in the strip to be coiled which are caused during the initial pass, the surface of the driving roller and of the supporting roller become uneven, and this can lead in turn to damage to the surface of the strip to be coiled.

In EP747147B1 or AT500689B1, the driving roller axle is mounted on a bearing region of the rockers, with the driving roller being located in each case underneath the rocker. The bearings of the driving roller are, in order to avoid damage during the push of the initial pass, are set in a play-free manner for example by spring-activated balancing.

It is not possible to remove the driving roller upward, since the rocker is in the way of such a removal and blocks the upward path. For removal downward, to the right or to the left, in the operating state the path is blocked by the supporting driving roller and the frame. Before removal becomes possible, therefore a blocked path has first to be opened.

In order to make it possible to clean and polish the driving roller and the supporting driving roller, normally the pair of rockers on which the driving roller is mounted is pivoted by means of rocker cylinders into an intermediate position; this is likewise necessary for exchanging the driving roller. The intermediate position is often reached after the pair of rockers has been pivoted through 180°. Subsequently, the driving roller and the supporting driving roller are usually cleaned and sanded or polished by hand in the installed state. There is a safety risk on account of cleaning and sanding or polishing in the plant. This is because the persons dealing with these processes have to position themselves within the plant between the plant parts, which thus have to be reliably shut down and blocked. In addition, there is a safety risk on account of the time pressure for carrying out these tasks, since cleaning and sanding or polishing have to be carried out in the time period of 10 to 15 minutes required for changing the working rolls of frameworks. If cleaning, sanding and polishing does not produce a sufficiently uniform surface on the driving roller or supporting driving roller, or in the event of damage, the driving roller or the supporting driving roller has to be removed from the frame, following pivoting of the rockers, and exchanged for a new driving roller or supporting driving roller. To this end, in the case of directional drivers according to EP747147B1 or AT500689B1, the entire rocker structure, including the driving roller, has to be uninstalled. On account of the multiplicity of connecting elements to be released and the mass of the frame including the driving roller, maintenance of driving rollers and supporting driving rollers causes a significant and time-consuming amount of work. Furthermore, it is not easy to access the driving roller for maintenance work when it is arranged between the rockers.

SUMMARY

One embodiment provides a driver for a steel strip coiler, having at least one supporting driving roller mounted on a frame, and at least one driving roller, which can be adjusted with respect to the supporting driving roller and is mounted on at least one rocker connected to the frame, wherein the driving roller is attached to a bearing region of the rocker, wherein the bearing region is open for the insertion or removal of the driving roller toward the side and/or upwardly when the rocker is placed in the operating position, and the driver has a fixing mechanism for fixing the driving roller to the bearing region.

In a further embodiment, the positioning of the driving roller with respect to the supporting driving roller in the fixed state can be changed by changing the setting of the fixing mechanism into different positions.

In a further embodiment, the fixing mechanism comprises a displaceable bar, which may be fixed to the rocker.

In a further embodiment, the driving roller is mounted between a pair of rockers, wherein the distance between the rockers is greater than the length of the supporting driving roller.

In a further embodiment, at least one of the rockers can be displaced or pivoted in relation to the other rocker.

In a further embodiment, the steel strip coiler is a steel strip coiler for a hot strip.

In a further embodiment, the driver is a directional driver.

In a further embodiment, the driving roller and the supporting driving roller are arranged in a holding arrangement.

In a further embodiment, the driving roller axle and/or the supporting driving roller axle about which the driving roller or the supporting driving roller rotates comprise(s) at least two driving roller axle parts and/or supporting driving roller axle parts, wherein at least one of the driving roller axle parts and/or supporting driving roller axle parts is configured as a shaft stub which is releasably fastened to the cylindrical body of the driving roller or supporting driving roller.

In a further embodiment, the supporting driving roller can be removed from the driver laterally in the direction of its longitudinal axis.

Another embodiment provides a method for removing a driving roller from a driver as disclosed above, wherein the method comprises opening the fixing mechanism, and removing the driving roller toward the side and/or upwardly from the driver.

In a further embodiment, after the removal of the driving roller, it additionally comprises the steps of releasing fixing arrangements for fixing the supporting driving roller in the driver, and removing the supporting driving roller upwardly from the driver.

In a further embodiment, during the removal of the driving roller, it additionally comprises the steps of releasing fixing arrangements for fixing the supporting driving roller in the driver, and removing the supporting driving roller by pulling it laterally out of the driver.

In a further embodiment, the driving roller and the supporting driving roller are removed from the driver in pairs by removing a holding arrangement in which a pair comprising a driving roller and a supporting driving roller is arranged.

BRIEF DESCRIPTION OF THE DRAWINGS

Exemplary embodiments will be explained in more detail below on the basis of the schematic drawings, wherein.

DETAILED DESCRIPTION

Figure 1A:
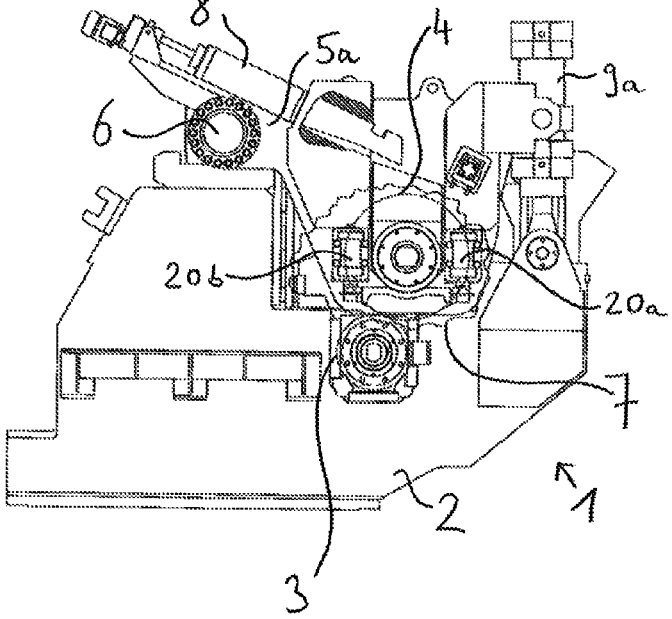
FIG. 1*a* shows a side view of an example embodiment of a driver.

Embodiments of the present disclosure provide a driver and a method for exchanging a driving roller in the driver are proposed, said driver and method causing a less time-consuming amount of work together with fewer safety risks during the changing of the driving roller than conventional drivers and methods.

For example, some embodiments provide a driver for a steel strip coiler, having at least one supporting driving roller mounted on a frame, and at least one driving roller, which can be adjusted with respect to the supporting driving roller and is mounted on at least one rocker connected to the frame, wherein the driving roller is attached to a bearing region of the rocker, wherein the bearing region is open for the insertion or removal of the driving roller toward the side and/or upwardly when the rocker is placed in the operating position, and the driver has a fixing mechanism for fixing the driving roller to the bearing region.

The bearing region should be understood to mean the region of the rocker in which the driving roller is attached to the rocker.

The bearing region is open for the insertion or removal of the driving roller toward the side and/or upwardly when the rocker is positioned in the operating position, and therefore the bearing region does not prevent the driving roller from being uninstalled toward the side and/or upwardly. A driving roller can therefore be removed from the rocker toward the side and/or upwardly as required without the rocker together with the driving roller having to be removed substantially from the operating position or without the rocker together with the driving roller having to be completely dismantled. The operating position should be understood as meaning a position of the rocker which is taken up in normal operation of the driver.

The driver may have a fixing mechanism for fixing the driving roller to the bearing region. As a result, it is ensured during operation that the driving roller does not escape undesirably toward the side and/or upwardly. In the fixed state, controlled displacement of the driving roller in different operating positions is possible.

The positioning of the driving roller with respect to the supporting driving roller in the fixed state can be changed by changing the setting of the fixing mechanism into different positions.

According to one embodiment, the fixing mechanism comprises a displaceable bar, which may be fixed to the rocker.

According to another embodiment, the fixing mechanism comprises a swing-action arrangement, the parts of which can be swung about at least one axle fastened to the rocker and which can be fixed to the rocker. For example, it may be two arms which can be swung into one another and which are locked by a displaceable wedge. Each of the arms swings in this case about a different axle.

The supporting driving roller may be located underneath the driving roller. It is therefore not possible to remove the supporting driving roller upwardly while the driving roller is installed in the driver. If the driving roller has been removed, the path for removing the supporting driving roller upwardly is open.

If the driving roller is mounted between a pair of rockers, the distance between the rockers may be greater than the length of the supporting driving roller. This ensures that the supporting driving roller can be removed upwardly on account of the free space caused by the removal of the driving roller.

If the distance between the rockers in the operating position is less than the length of the supporting driving roller, it may be preferred for at least one of the rockers to be able to be displaced or pivoted in relation to the other rocker when the driving roller has been uninstalled. As a result of this, the supporting driving roller can be removed.

The steel strip coiler may be a steel strip coiler for a hot strip.

The driver may be a directional driver.

According to a one embodiment, the driving roller and the supporting driving roller are arranged in a holding arrangement.

The holding arrangement, which may be for example a holding frame, thus contains both the driving roller and the supporting driving roller.

As a result, in order to remove or insert a pair comprising a driving roller and supporting driving roller, all that is required is to act on the holding arrangement and to remove it from the driver.

On account of the fact that the driving roller and the supporting driving roller do not have to be removed individually from or inserted individually into the driver, removal and insertion can be carried out more quickly.

The supporting driving roller can be mounted on the frame in a stationary or displaceable manner.

According to one embodiment, the driving roller axle and/or the supporting driving roller axle about which the driving roller or the supporting driving roller rotates comprise(s) at least two driving roller axle parts and/or supporting driving roller axle parts, wherein at least one of the driving roller axle parts is configured as a shaft stub which is releasably fastened—for example via a connecting flange, a perforated disk having displaceable drive pins, or a claw coupling—to the cylindrical body of the driving roller or supporting driving roller. In this case, the shaft stub can be configured as a hollow shaft, into which a motor-driven shaft can be introduced for driving the driving roller or the supporting driving roller. This makes it possible to remove the driving roller and/or supporting driving roller quickly from the driver, and this reduces the safety risk caused by time pressure while changing the driving roller.

According to one embodiment of the driver, the supporting driving roller can be removed from the driver laterally in the direction of its longitudinal axis. It can also be introduced into the driver laterally in the direction of its longitudinal axis.

In the drivers shown in EP747147B1 or AT500689B1, one end of the rockers can be rotated about a rotary axle while the other end of the rockers is connected to an actuating device such as, for example, a pressure-medium cylinder, e.g., a hydraulic cylinder. By adjusting this actuating device, the rockers can be pivoted about their rotary axle, for example in order to allow the removal of the driving roller or in order to control or regulate the distance between the driving roller and the supporting driving roller.

The bearing region of the driving roller is located between the pivotable end of the rocker and the end of the rocker connected to the actuating device.

In the case of the driver, the rockers can be pivoted about a rotary axle arranged in a rotary axle region of the rockers, and they are connected in an actuating region to an actuating device. In this case, the bearing region of the driving roller can, as in EP747147B1 or AT500689B1, be located between the rotary axle region and the actuating region.

According to another embodiment, the rotary axle region can be located between the bearing region and the actuating region. An advantage of such an embodiment is that during the pressing of the driving roller, forces flow off better into the rocker and more favorable stress states for the rocker are generated. The effective distance of an actuating arrangement that acts on one end of the rocker can also be increased structurally more easily in such a structure than in embodiments configured as in EP747147B1 or AT500689B1. On account of an increased effective distance, the same forces can be achieved with smaller actuating devices or larger forces can be achieved with the same actuating devices.

Other embodiments provide a method for removing a driving roller from a driver, which may include the steps of

- opening the fixing mechanism, and
- removing the driving roller toward the side and/or upwardly from the driver.

Opening the fixing mechanism should be understood as meaning that the fixing of the driving roller to the bearing region is released.

The supporting driving roller in a driver may be secured in the driver by fixing arrangements in order that its position does not change at all in normal operation or its position does not change beyond an acceptable degree. The supporting driving roller can in this case be fixed so that no movement at all is possible. It can also be displaceable to an acceptable or desired degree. The degree of displaceability that is acceptable or desired depends on the respective operating state. In order to be able to change the deflection forces of the driver in a manner dependent on the strip thickness and strip quality, it is possible for example to change the distance between the axles of the driving roller and the supporting driving roller to a certain degree.

In one embodiment of the method, after the removal of the driving roller, it additionally comprises the steps of

- releasing fixing arrangements for fixing the supporting driving roller in the driver, and
- removing the supporting driving roller upwardly from the driver.

On account of the opening caused by the removal of the driving roller, the supporting driving roller can also be removed upwardly from the driver.

According to another embodiment, the supporting driving roller can be pulled laterally, that is to say in the direction of its longitudinal axis, from the driver in order to remove it.

This can take place before or after the removal of the driving roller as disclosed herein. It can also take place during the removal of the driving roller from the driver; in this way, the driving roller and the supporting driving roller can be removed more quickly than if the two removals take place in succession.

In one embodiment, the method includes, during the removal of the driving roller, the additional steps of

- releasing fixing arrangements for fixing the supporting driving roller in the driver, and
- removing the supporting driving roller by pulling it laterally out of the driver.

According to one embodiment, the driving roller and the supporting driving roller are removed from the driver in pairs by removing a holding arrangement in which a pair comprising a driving roller and a supporting driving roller is arranged.

Figure 1B:
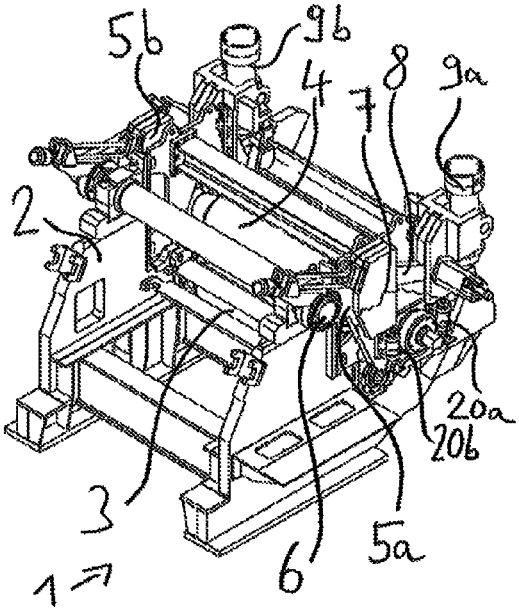
FIG. 1*b* shows an elevated oblique view of a driver according to FIG. 1*a*.

FIG. 1*a* shows a side view of a driver 1 according to an example embodiment for a steel strip coiler, specifically a directional driver for a hot-strip coiler. The driver 1 comprises a supporting driving roller 3 mounted on a frame 2, and a driving roller 4 that can be adjusted with respect to the supporting driving roller. In FIG. 1, the driving roller 4 and the supporting driving roller 3 are illustrated merely by dashed lines, since in the side view they are hidden by the frame 2 and other parts of the driver. The driving roller 4 is mounted on a pair of rockers 5*a*, 5*b* connected to the frame. In the side view in FIG. 1, only one rocker 5*a* can be seen; the second rocker 5*b* of the pair is hidden by the rocker 5*a* in this view. The pair of rockers 5*a*, 5*b* is located in the operating position. The pair of rockers 5*a*, 5*b* can be pivoted about a rotary axle 6 of the frame 2. The driving roller 4 is attached to a bearing region 7 of the rockers. The bearing region 7 is open for the insertion or removal of the driving roller 4 toward the side upwardly with the rockers in the operating position. The bearing region is shown by way of a wavy closed line. A fixing mechanism for fixing the driving roller 4 to the bearing region 7 is present and is configured as a displaceable bar 8. In the illustrated position of the bar 8, the latter has not yet been displaced into its end position, in which it fixes the driving roller 4 to the bearing region 7. To present a clear overview, a part of the rocker 5 is illustrated in section so that part of the course of the bar 8 in the rocker 5 is shown. When the bar 8 is moved from the illustrated position into its end position, as can be seen in the following FIG. 1*b*, the driving roller 4 is fixed and the balancing pots 20*a*, 20*b* for setting the bearings of the driving roller 4 in a play-free manner are activated.

FIG. 1*b* shows an elevated oblique view of a driver 1 according to FIG. 1*a*. Parts identical to FIG. 1*a* are provided with identical reference signs. In contrast to FIG. 1*a*, the bar 8 of the fixing mechanism is illustrated in its end position, in which it fixes the driving roller to the bearing region 7 of the rockers 5*a*, 5*b*. The driving roller 4 and the supporting driving roller 3 can be seen more clearly than in FIG. 1*a*. The second rocker 5*b* of the pair of rockers 5*a*, 5*b* can be seen, unlike in FIG. 1*a*.

Both in FIG. 1*a* and in FIG. 1*b*, one end of the rockers 5*a*, 5*b* is connected in each case with an actuating device, specifically a hydraulic cylinder 9*a*, 9*b*. By adjusting this hydraulic cylinder 9*a*, 9*b*, the rockers 5*a*, 5*b* can be pivoted about their rotary axle 6, for example in order to set the distance of the driving roller 4 from the supporting driving roller 3.

The bearing region 7 of the driving roller is located between that end of the rockers 5*a*, 5*b* which can be pivoted about the rotary axle 6 and that end of the rockers 5*a*, 5*b* which is connected to the hydraulic cylinder 9*a*, 9*b* of the actuating device.

Figure 2:
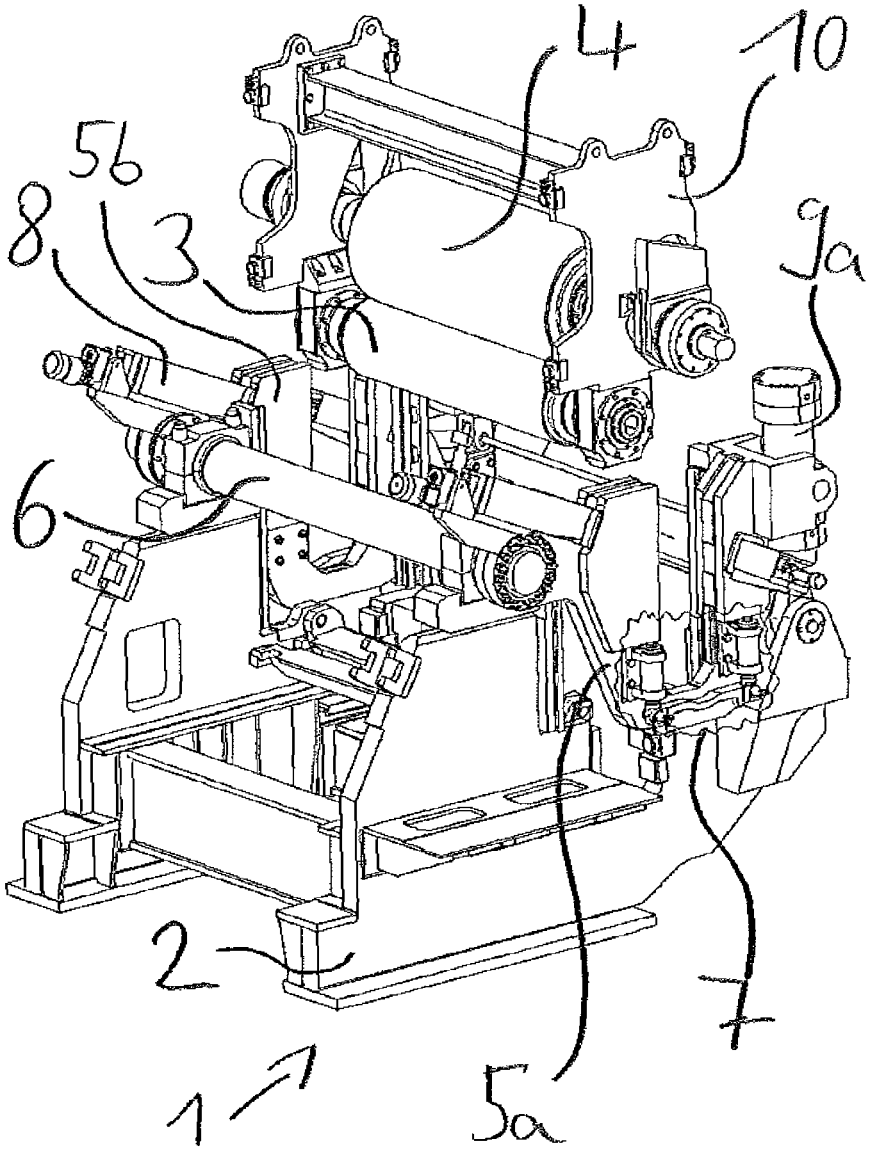
FIG. 2 shows an elevated oblique view of a driver according to FIG. 1*b* having a driving roller and a supporting driving roller arranged in a holding arrangement.

FIG. 2 shows a further elevated oblique view of a driver according to FIG. 1*b*. Parts identical to FIG. 1*b* are provided with identical reference signs. In contrast to FIG. 1*b*, the bar 8 of the fixing mechanism is illustrated in its starting position, in which it does not fix the driving roller to the bearing region 7. The driving roller 4 and the supporting driving roller 3 are not installed in the driver 1. They are arranged in a holding arrangement, specifically a holding frame 10. The installation and removal of the driving roller 4 and the supporting driving roller 3 take place by introducing the holding frame 10 into the frame 2 of the driver 1 and removing it therefrom.

Figure 3:
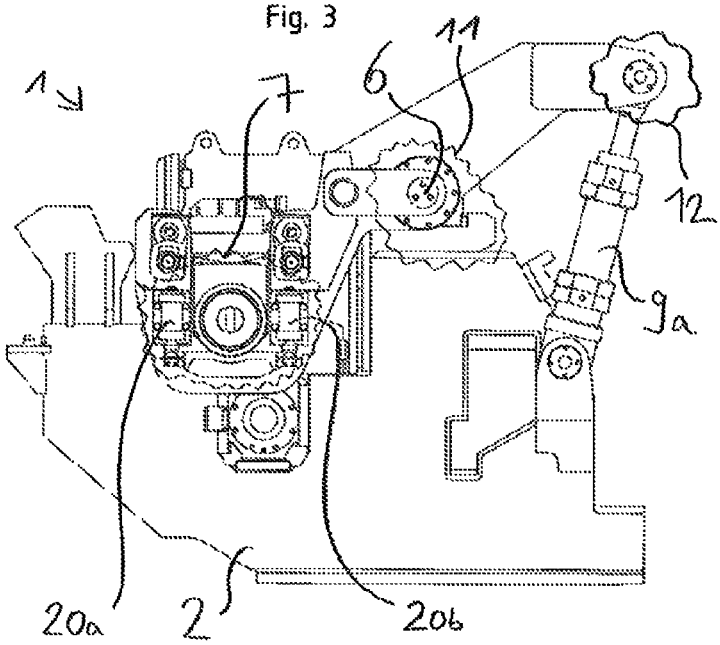
FIG. 3 shows an example embodiment of a driver in which the rotary axle region 11 is located between the bearing region 7 and the actuating region 12.

FIG. 3 shows a side view similar to FIG. 1*a* of a driver according to an example embodiment. Parts identical to FIG. 1*a* are provided with identical reference signs. To present a clear overview, the driving roller 4 and the supporting driving roller 3 are not illustrated. The rotary axle 6 is arranged in a rotary axle region 11 of the rocker 5*a*. The hydraulic cylinder 9*a* is arranged in an actuating region 12 of the rocker 5*a*. In contrast to FIG. 1*a*, the rotary axle region 11 is located between the bearing region 7 and the actuating region 12.

Figure 4:
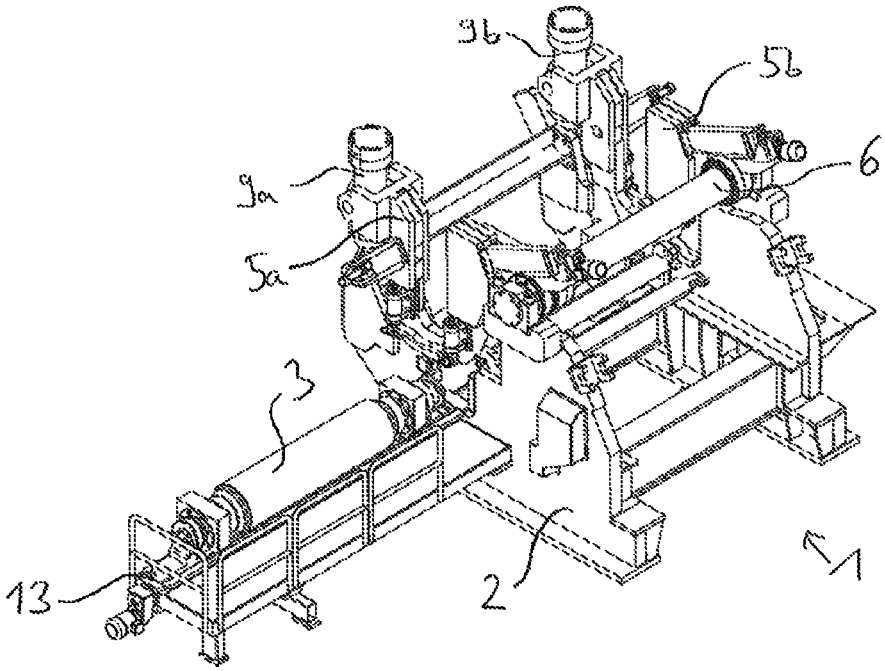
FIG. 4 shows an elevated oblique view of a driver with the supporting driving roller removed.

FIG. 4 shows an elevated oblique view similar to FIG. 1*b* of a driver according to an example embodiment. Parts identical to FIG. 1*b* are provided with identical reference signs. No driving roller has been inserted into the driver 1 and thus it is not illustrated. The supporting driving roller has likewise not been inserted. FIG. 4 shows the supporting driving roller in the removed state. The supporting driving roller 3 can be removed from the driver 1 or can be introduced into the driver 1 laterally in the direction of its longitudinal axis. FIG. 4 shows a removal framework, on which the supporting driving roller 3 is guided out of the driver 1 or is introduced into the driver 1.

Figure 5:
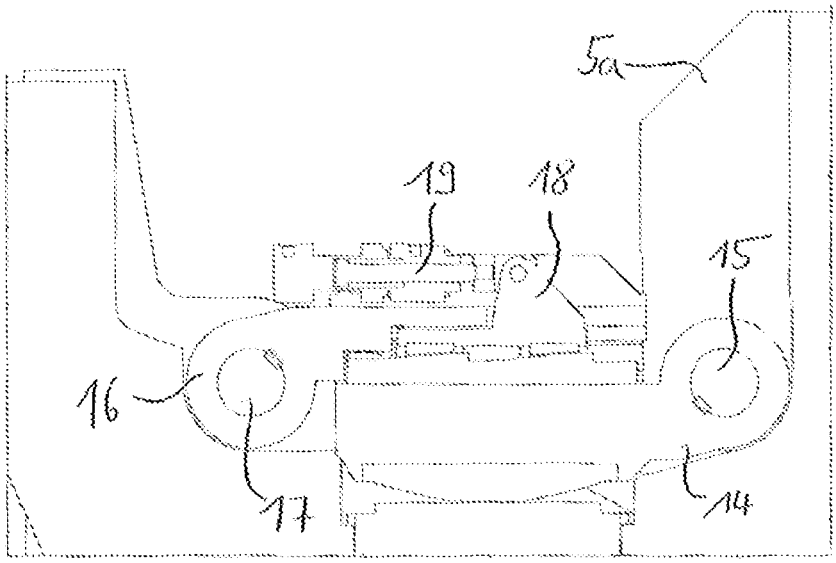
FIG. 5 shows an alternative to the fixing mechanism for fixing the driving roller to the bearing region.

The fixing mechanism for fixing the driving roller 4 to the bearing region 7 does not have to be configured as a displaceable bar 8. FIG. 5 shows an alternative fixing mechanism, which has a swing-action arrangement having two arms 14, 16, which can be swung into one another and are locked by a displaceable wedge arrangement 18. Each of the arms 14, 16 swings in this case about a different axle: arm 14 about axle 15 and arm 16 about axle 17. The two arms 14, 16 are connected to the rocker 5*a* via the axles 15, 17. The displaceable wedge arrangement 18 is fastened to the arm 16; it can be displaced by means of a hydraulic cylinder 19. The arm 14 has protuberances which fit into indentations on the displaceable wedge arrangement 18. When the fixing mechanism is closed, the arms 14, 16 swing into the illustrated position and the hydraulic cylinder 19 displaces the displaceable wedge arrangement 18 such that the indentations slide over the protuberances. In this way, the two arms 14, 16 are locked together.

Figure 6:
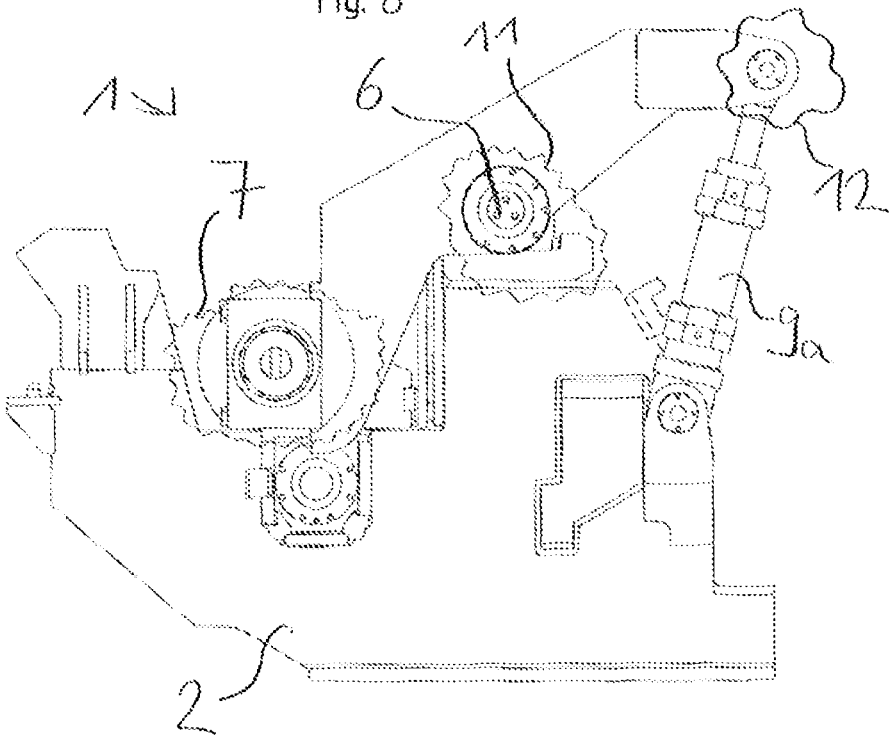
FIG. 6 shows a further embodiment of a driver in which the rotary axle region 11 is located between the bearing region 7 and the actuating region 12.

FIG. 6 shows a side view similar to FIG. 1*a* and FIG. 3 of a driver according to an example embodiment. Parts identical to FIG. 1*a* are provided with identical reference signs. The rotary axle 6 is arranged in a rotary axle region 11 of the rocker 5*a*. The hydraulic cylinder 9*a* is arranged in an actuating region 12 of the rocker 5*a*. As in FIG. 3, in contrast to FIG. 1*a*, the rotary axle region 11 is located between the bearing region 7 and the actuating region 12. FIG. 3 and FIG. 6 differ in the form of the rocker 5*a* and the way in which the driving roller is attached to the bearing region of the rocker.

LIST OF REFERENCE SIGNS

1 Driver
2 Frame
3 Supporting driving roller
4 Driving roller
5*a*, 5*b* Rocker
6 Rotary axle
7 Bearing region
8 Bar
9*a*, 9*b* Hydraulic cylinder
10 Holding frame
11 Rotary axle region
12 Actuating region
13 Removal framework
14 Arm
15 Axle
16 Arm
17 Axle
18 Displaceable wedge arrangement
19 Hydraulic cylinder
20*a*, 20*b* Balancing pots

What is claimed is:

1. A driver for a steel strip coiler, comprising:

a supporting driving roller mounted on a frame, and a driving roller adjustable with respect to the supporting driving roller and mounted on at least one rocker connected to the frame, wherein the driving roller is attached to a bearing region of the rocker, the bearing region being open for the insertion or removal of the driving roller toward a side and/or upwardly when the rocker is placed in an operating position, and a fixing mechanism for fixing the driving roller to the bearing region.

2. The driver of claim 1, wherein the positioning of the driving roller with respect to the supporting driving roller in the fixed state is adjustable by adjusting the setting of the fixing mechanism into different positions.

3. The driver of claim 1, wherein the fixing mechanism comprises a displaceable bar that may be fixed to the rocker.

4. The driver of claim 1, wherein the driving roller is mounted between a pair of rockers, wherein a distance between the rockers is greater than a length of the supporting driving roller.

5. The driver of claim 1, wherein at least one of the rockers is configured for displacement or pivoting in relation to the other rocker.

6. The driver of claim 1, wherein the steel strip coiler is a steel strip coiler for a hot strip.

7. The driver of claim 1, wherein the driver is a directional driver.

8. The driver of claim 1, wherein the driving roller and the supporting driving roller are arranged in a holding arrangement.

9. The driver of claim 1, wherein at least one of a driving roller axle and a supporting driving roller axle about which the driving roller or the supporting driving roller rotates comprises at least two driving roller axle parts or supporting driving roller axle parts, wherein at least one of the driving roller axle parts or supporting driving roller axle parts is configured as a shaft stub which is releasably fastened to the cylindrical body of the driving roller or supporting driving roller.

10. The driver of claim 1, wherein the supporting driving roller is removable from the driver laterally in the direction of its longitudinal axis.

11. A method for removing a driving roller from a driver comprising (a) a supporting driving roller mounted on a frame, (b) the driving roller which is adjustable with respect to the supporting driving roller and which is mounted on at least one rocker connected to the frame, wherein the driving roller is attached to a bearing region of the rocker, the bearing region being open for the insertion or removal of the driving roller toward a side and/or upwardly when the rocker is placed in an operating position, and (c) a fixing mechanism for fixing the driving roller to the bearing region, the method comprising:

opening the fixing mechanism, and removing the driving roller in a direction toward a side and/or upwardly from the driver.

12. The method of claim 11, further comprising, after the removal of the driving roller:

releasing fixing arrangements for fixing the supporting driving roller in the driver, and removing the supporting driving roller upwardly from the driver.

13. The method of claim 11, further comprising, during the removal of the driving roller:

releasing fixing arrangements for fixing the supporting driving roller in the driver, and removing the supporting driving roller by pulling it laterally out of the driver.

14. The method of claim 11, wherein the driving roller and the supporting driving roller are removed from the driver in pairs by removing a holding arrangement in which a pair comprising a driving roller and a supporting driving roller is arranged.

* * * * *